US009171513B2

(12) United States Patent
Kim et al.

(10) Patent No.: US 9,171,513 B2
(45) Date of Patent: Oct. 27, 2015

(54) LUMINANCE ADJUSTMENT PART, DISPLAY APPARATUS HAVING THE LUMINANCE ADJUSTMENT PART, AND METHOD FOR ADJUSTING LUMINANCE

(71) Applicant: SAMSUNG DISPLAY CO., LTD., Yongin, Gyeonggi-Do (KR)

(72) Inventors: Jung-Taek Kim, Seoul (KR); Cheol-Woo Park, Suwon-si (KR); Yun-Ki Baek, Suwon-si (KR); Kyoung-Ju Shin, Hwaseong-si (KR); Hee-Soon Jeong, Suwon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 183 days.

(21) Appl. No.: 13/938,118

(22) Filed: Jul. 9, 2013

(65) Prior Publication Data

US 2014/0240367 A1 Aug. 28, 2014

(30) Foreign Application Priority Data

Feb. 28, 2013 (KR) ..... 10-2013-0022169

(51) Int. Cl.
*G09G 5/10* (2006.01)
*G09G 3/36* (2006.01)

(52) U.S. Cl.
CPC ..... *G09G 3/3648* (2013.01)

(58) Field of Classification Search
CPC ..... G09G 3/3648
USPC ..... 345/32, 84, 88, 102, 204, 589, 590, 345/690, 691; 348/642, 743; 382/162, 167; 358/1.9, 474
See application file for complete search history.

(56) References Cited

U.S. PATENT DOCUMENTS

| | | | | |
|---|---|---|---|---|
| 7,202,458 | B2 | 4/2007 | Park | |
| 7,414,608 | B2 | 8/2008 | Funamoto et al. | |
| 7,575,330 | B2 * | 8/2009 | Allen et al. | 353/85 |
| 8,115,787 | B2 * | 2/2012 | Ben-Chorin et al. | 345/690 |
| 8,139,020 | B2 | 3/2012 | Ohshima | |
| 8,179,391 | B2 | 5/2012 | Hong et al. | |
| 8,203,572 | B2 | 6/2012 | Park et al. | |
| 2005/0134612 | A1 * | 6/2005 | Kempf | 345/690 |
| 2008/0024683 | A1 * | 1/2008 | Damera-Venkata et al. | 348/744 |
| 2008/0111799 | A1 * | 5/2008 | Hoppenbrouwers et al. | 345/204 |
| 2008/0266330 | A1 * | 10/2008 | Park et al. | 345/690 |

(Continued)

FOREIGN PATENT DOCUMENTS

| | | |
|---|---|---|
| KR | 1020090037655 | 4/2009 |
| KR | 1020110088050 | 8/2011 |
| KR | 20120115576 | 10/2012 |

*Primary Examiner* — Prabodh M Dharia
(74) *Attorney, Agent, or Firm* — Innovation Counsel LLP

(57) ABSTRACT

A luminance adjustment part includes a luminance determination part and a data compensation part. The luminance determination part may determine a control value for controlling luminance of a backlight assembly using linear image data that has a linear luminance profile and is generated by performing a de-gamma process on a first copy of input image data that has a nonlinear luminance profile. The compensation part may compensate pixel data that corresponds to pixels of a display panel using the control value, the pixel data being generated using a second copy of the input image data. Thus, color distortion of a displayed image as perceived by a viewer may be minimized when power consumption of a display apparatus that includes the display panel is decreased.

18 Claims, 5 Drawing Sheets

(56) References Cited

U.S. PATENT DOCUMENTS

| | | | | |
|---|---|---|---|---|
| 2009/0040207 | A1* | 2/2009 | Park et al. | 345/211 |
| 2009/0267926 | A1* | 10/2009 | Seo et al. | 345/204 |
| 2009/0284545 | A1* | 11/2009 | Watanabe et al. | 345/589 |
| 2010/0033513 | A1* | 2/2010 | Choi et al. | 345/690 |
| 2010/0039368 | A1* | 2/2010 | Kim et al. | 345/102 |
| 2010/0066752 | A1* | 3/2010 | Watanuki | 345/589 |
| 2010/0195901 | A1* | 8/2010 | Andrus et al. | 382/162 |
| 2010/0214209 | A1* | 8/2010 | Seo et al. | 345/102 |
| 2010/0225574 | A1* | 9/2010 | Fujiwara et al. | 345/102 |
| 2011/0109658 | A1 | 5/2011 | Park | |
| 2011/0148941 | A1* | 6/2011 | Kim et al. | 345/690 |
| 2011/0157260 | A1* | 6/2011 | Pyun et al. | 345/691 |
| 2011/0193895 | A1* | 8/2011 | Johnson et al. | 345/690 |
| 2013/0044146 | A1* | 2/2013 | Kurokawa et al. | 345/690 |
| 2013/0223733 | A1* | 8/2013 | Tripathi et al. | 382/167 |
| 2014/0078193 | A1* | 3/2014 | Barnhoefer et al. | 345/690 |

* cited by examiner

LUMINANCE ADJUSTMENT PART, DISPLAY APPARATUS HAVING THE LUMINANCE ADJUSTMENT PART, AND METHOD FOR ADJUSTING LUMINANCE

PRIORITY STATEMENT

This application claims benefit of and priority under 35 U.S.C. §119 to Korean Patent Application No. 10-2013-0022169, filed on Feb. 28, 2013 in the Korean Intellectual Property Office KIPO, the contents of which are incorporated herein by reference.

BACKGROUND OF THE INVENTION

1. Field of the Invention

The present invention is related to a luminance adjustment part, a display apparatus having the luminance adjustment part, and a method of adjusting luminance using the luminance adjustment part. The luminance adjustment part may minimize power consumption and/or may minimize color distortion.

2. Description of the Related Art

Generally, a liquid crystal display apparatus includes a liquid crystal display panel for displaying an image and includes a light source module for providing a light to the liquid crystal display panel. For example, the light source module may be a backlight assembly.

The liquid crystal display panel may include a set of pixel electrodes, a common electrode, and a liquid crystal layer disposed between the set of pixel electrodes and the common electrode. Voltages may be applied to the pixel electrodes and the common electrode to generate an electric field. When the electric field is adjusted, the light transmittance of the liquid crystal layer is adjusted so that a desired image is displayed.

The light source module includes a plurality of light sources for providing light to the liquid crystal display panel. For example, the light sources may include at least one of a cold cathode fluorescent lamp ("CCFL"), an external electrode fluorescent lamp ("EEFL"), a flat fluorescent lamp ("FFL"), and a light emitting diode ("LED").

The luminance of the light source module may be adjusted according to the image to be displayed on the display panel, in order to decrease power consumption of the display apparatus. For example, when a relatively dark image is to be displayed, the luminance of the light source module may be decreased. When the luminance of the light source module decreases, a grayscale of the image may be increased according to the luminance of the light source module, in order to compensate image data.

A maximum value among red (R) data, green (G) data, and blue (B) data of a pixel may be used to adjust the luminance of the light source module. Nevertheless, the maximum value among the red (R) data, the green (G) data, and the blue (B) data may not satisfactorily represent luminance perceived by human eyes. As a result, the luminance of the displayed image as perceived by a viewer may appear to be distorted.

If the image data is compensated using the distorted luminance, hue, chrominance, and/or luminance of the displayed image may be further distorted.

SUMMARY OF THE INVENTION

One or more embodiments of the present invention are related to a luminance adjustment part that may facilitate decreasing power consumption and minimizing color distortion.

One or more embodiments of the present invention are related to a display apparatus that includes the luminance adjustment part.

One or more embodiments of the present invention are related to a method for adjusting luminance using the luminance adjustment part.

In one or more embodiments, the luminance adjustment part may include a luminance determination part configured to determine a control value for controlling luminance of a backlight assembly using linear image data, the linear image data being generated by performing a de-gamma process on a first copy of input image data, the linear image data having a linear profile, the input image data having a nonlinear profile. For example, the linear image data may include luminance represented by a linear function of grayscale, and the input image data may include luminance represented by a nonlinear function of grayscale. The luminance adjustment part may further include a data compensation part configured to compensate pixel data that corresponds to pixels of a display panel using the control value, the pixel data being generated using a second copy of the input image data.

In an embodiment, the input image data is specified in accordance with an RGB color space, and wherein the pixel data is specified in accordance with a YCbCr color space.

In an embodiment, the luminance determination part is configured to determine the control value associated with a second frame using at least one of an average luminance value of extracted luminance values corresponding to a first frame and a maximum luminance value of the extracted luminance values corresponding to the first frame, the extracted luminance values being extracted from the linear image data.

In an embodiment, the luminance determination part comprises a low pass filter for adjusting the control value such that a change of the control value does not exceed a threshold during two consecutive frames, such that a viewer may not perceive undesirable, drastic brightness change in displayed images.

In an embodiment, the luminance adjustment part may further include the following elements: a de-gamma part for receiving the input image data and for generating the linear image data using the input image data; a luminance extraction part for extracting extracted luminance values from the linear image data; an average luminance determination part for determining an average luminance value associated with a frame using the extracted luminance values; and a maximum luminance determination part for determining a maximum luminance value associated with the frame using the extracted luminance values.

In an embodiment, the linear image data have data values specified in accordance with a RGB color space and including red data, green data, and blue data that have respective linear profiles, and at least one of the extracted luminance values is determined as a sum of about 20% of the red data, about 70% of the green data, and about 10% of the blue data.

In an embodiment, the luminance adjustment part may further include the following elements: a first conversion part for receiving the second copy of the input image data and for converting the second copy of the input image data into the pixel data, the input image data being specified according to an RGB color space, the pixel data being specified according to a YCbCr color space; and a second conversion part for receiving compensated data that is specified according to the YCbCr color space from the data compensation part and for converting the compensated data into compensated pixel data that is specified according to the RGB color space.

In an embodiment, the data compensation part is configured to multiply a luma component of the pixel data by a luminance compensation ratio. If the luminance compensation ratio is represented by LCR and if a duty ratio for controlling the backlight assembly is represented by DC, then $$LCR = \left(1 - \frac{DC}{100}\right)^{1.4}.$$

In an embodiment, the data compensation part is configured to multiply a luma component of the pixel data by a luminance compensation ratio. If the luminance compensation ratio is represented by LCR, if a duty ratio for controlling the backlight assembly is represented by DC, if the duty ratio is between about 25% and about 50%, then $$LCR = \left(\frac{1 - \frac{DC}{100}}{0.8}\right)^{2.2},$$

and if the duty ratio is greater than about 50%, then $$LCR = \left(1 - \frac{DC}{100}\right)^{1.4}.$$

In an embodiment, the data compensation part may include the following elements: a luminance compensation part for multiplying a luma component of the pixel data by a luminance compensation ratio to generate a multiplication result; and a tone disappearance compensation part for compensating tone disappearance if the multiplication result is greater than a threshold value.

In an embodiment, a boundary value of a color range is set based on a color space associated with the pixel data and a duty ratio received from the luminance determination part, the control value including the duty ratio. The boundary value of the color range may be multiplied by a constant value to determine the threshold value. If an input luminance value Yin represents the multiplication result, if an output luminance value Yout represents an output of the tone disappearance compensation part, if the boundary value of the color range is represented by C1, if the threshold value is represented by C2, and if a result of multiplying C1 by a luminance compensation ratio LCR is represented by C3, then $$Yout = \left(\frac{C1 - C2}{C3 - C2}\right) \times (Yin - C2) + C2.$$

One or more embodiments may be related to a display apparatus that includes the following elements: a display panel for displaying an image; a backlight assembly for providing light to the display panel; a gate driver for providing a gate signal to the display panel; a data driver for providing a data voltage to the display panel; and a backlight driver for providing a backlight driving signal to the backlight assembly. The display apparatus may further include a timing controller for controlling the gate driver, the data driver, and the backlight driver. The timing controller may include a luminance determination part configured to determine a control value for controlling luminance of the backlight assembly using linear image data, the linear image data being generated by performing a de-gamma process on a first copy of input image data, the linear image data having a linear profile, the input image data having a nonlinear profile. The timing controller may further include a data compensation part configured to compensate pixel data that corresponds to pixels of the display panel using the control value, the pixel data being generated using a second copy of the input image data.

One or more embodiments of the invention may be related to a method for adjusting luminance. The method may be implemented using a luminance adjustment part that includes hardware and may include the following steps: generating linear image data by performing a de-gamma process on a first copy of input image data, the linear image data having a linear profile, the input image data having a nonlinear profile; determining a control value for controlling luminance of a backlight assembly using the linear image data; generating pixel data that corresponds to pixels of a display panel using a second copy of the input image data; and compensating the pixel data using the control value.

In an embodiment, the input image data is specified in accordance with an RGB color space, and wherein the pixel data is specified in accordance with a YCbCr color space.

In an embodiment, the control value associated with a second frame is determined using at least one of an average luminance value of extracted linear luminance values corresponding to a first frame and a maximum luminance value of the extracted luminance values corresponding to the first frame, the extracted luminance values being extracted from the linear image data.

In an embodiment, the method may include low pass filtering the control value such that a change of the control value does not exceed a threshold during two consecutive frames.

In an embodiment, the method may include the following steps: extracting extracted luminance values from the linear image data; determining an average luminance value associated with a frame using the extracted luminance values; and determining a maximum luminance value associated with the frame using the extracted luminance values.

In an embodiment, the linear image data have data values specified in accordance with a RGB color space and including red data, green data, and blue data that have respective linear profiles. At least one of the extracted luminance values is a sum of about 20% of the red data, about 70% of the green data and about 10% of the blue data.

In an embodiment, the method may include the following steps: converting the second copy of the input image data into the pixel data, the input image data being specified according to an RGB color space, the pixel data being specified according to a YCbCr color space; compensating the pixel data to generate compensated data that is specified in accordance with the YCbCr color space; and converting the compensated data into compensated pixel data that is specified according to the RGB color space.

In an embodiment, the compensating the pixel data may include the following steps: multiplying a luma component of the pixel data by a luminance compensation ratio to generate a multiplication result; and compensating tone disappearance when the multiplication result is greater than a threshold value.

One or more embodiments of the invention may be related to a luminance adjustment part that includes a luminance determination part and a data compensation part. The luminance determination part may determine a control value for controlling luminance of a backlight assembly using a de-gamma image data. The de-gamma image data are generated by operating de-gamma process to a first copy of input image data. The compensation part may compensate pixel data that corresponds to pixels of a display panel using the control value. The pixel data may be generated using a second copy of the input image data.

In an embodiment, the luminance determination part may determine the luminance of the backlight assembly using a linear luminance value of the input image data. The data compensation part may compensate the pixel data of the display panel using a non-linear luminance value of the input image data.

In an embodiment, the luminance determination part may determine the luminance of the backlight assembly of a second frame based on an average luminance value of the linear luminance value corresponding to a first frame and a maximum luminance value of the linear luminance value corresponding to the first frame.

In an embodiment, the luminance determination part may include a low pass filter adjusting the luminance of the backlight assembly such that the luminance of the backlight assembly does not drastically change according to a frame.

In an embodiment, the luminance adjustment part may further include a de-gamma part receiving the input image data and generating the de-gamma image data based on the input image data, a luminance extraction part extracting the linear luminance value based on the de-gamma image data, an average luminance determination part determining the average luminance value of a frame based on the linear luminance value and a maximum luminance determination part determining the maximum luminance value of the frame based on the linear luminance value.

In an embodiment, the de-gamma image data may have a RGB color space. The linear luminance value may be determined as a sum of about 20% of de-gamma red data, about 70% of de-gamma green data and about 10% of de-gamma blue data.

In an embodiment, the input image data may have a RGB color space. The luminance adjustment part may further include a first conversion part receiving the input image data and converting the input image data into a YCbCr color space and a second conversion part receiving compensated data having the YCbCr color space from the data compensation part and converting the compensated data into the RGB color space.

In an embodiment, the data compensation part may multiply a luminance compensation ratio to a luma component of the pixel data to compensate the pixel data. When the luminance compensation ratio is LCR and a duty ratio of the backlight assembly is DC, $$LCR = \left(1 - \frac{DC}{100}\right)^{1.4}.$$

In an embodiment, the data compensation part may multiply a luminance compensation ratio to a luma component of the pixel data to compensate the pixel data. When the luminance compensation ratio is LCR, a duty ratio of the backlight assembly is DC and the duty ratio of the backlight assembly is between about 25% and about 50%, $$LCR = \left(\frac{1 - \frac{DC}{100}}{0.8}\right)^{2.2}$$

When the duty ratio of the backlight assembly is greater than about 50%, $$LCR = \left(1 - \frac{DC}{100}\right)^{1.4}.$$

In an embodiment, the data compensation part may include a luminance compensation part multiplying a luminance compensation ratio to a luma component of the pixel data and a tone disappearance compensation part compensating tone disappearance when a result of the multiplication of the luminance compensation ratio to the luma component of the pixel data is greater than a threshold value.

In an embodiment, a boundary value of a color range may be set based on a color space of the pixel data and a duty ratio of the backlight assembly. A constant value may be multiplied to the boundary value of the color range to determine the threshold value. When an input luminance value Yin is defined as a multiplication result of the luminance compensation ratio to the luma component of the pixel data, and an output luminance value Yout is defined as an output of the tone disappearance compensation part, the boundary value of the color range is C1, the threshold value is C2 and a result of a multiplication of the luminance compensation ratio LCR to the boundary value C1 of the color range is C3, $$Yout = \left(\frac{C1 - C2}{C3 - C2}\right) \times (Yin - C2) + C2.$$

One or more embodiments of the invention may be related to a display apparatus that includes a display panel, a backlight assembly, a gate driver, a data driver, a backlight driver and a timing controller. The display panel may display an image. The backlight assembly may provide light to the display panel. The gate driver may provide a gate signal to the display panel. The data driver may provide a data voltage to the display panel. The backlight driver may provide a backlight driving signal to the backlight assembly. The timing controller may include a luminance determination part for determining a control value for controlling luminance of the backlight assembly using a de-gamma image data generated by operating de-gamma process to input image data; the timing controller may further include a data compensation part for compensating pixel data (generated using a second copy of the input image data and corresponding to pixels of the display panel) using the control value. The timing controller may control the gate driver, the data driver, and the backlight driver.

One or more embodiments of the invention may be related to a method for adjusting luminance. The method may include determining a control value for controlling luminance of a backlight assembly using de-gamma image data. The method may further include compensating pixel data (generated using input image data and corresponding to pixels of a display panel) using the control value.

In an embodiment, the luminance of the backlight assembly may be determined using a linear luminance value of the input image data. The pixel data of the display panel may be compensated using a nonlinear luminance value of the input image data.

In an embodiment, the luminance of the backlight assembly of a second frame may be determined based on an average luminance value of the linear luminance value corresponding to a first frame and a maximum luminance value of the linear luminance value corresponding to the first frame.

In an embodiment, the determining luminance of a backlight assembly may include low pass filtering the luminance of the backlight assembly such that the luminance of the backlight assembly does not drastically change according to a frame.

In an embodiment, the determining luminance of a backlight assembly may further include extracting the linear luminance value based on the de-gamma image data, determining the average luminance value of a frame based on the linear luminance value and determining the maximum luminance value of the frame based on the linear luminance value.

In an embodiment, the de-gamma image data may have a RGB color space. The extracting the linear luminance value may include calculating a sum of about 20% of de-gamma red data, about 70% of de-gamma green data and about 10% of de-gamma blue data.

In an embodiment, the input image data may have a RGB color space. The compensating the pixel data may include converting the input image data into a YCbCr color space, compensating the pixel data having the YCbCr color space and converting the compensated data having the YCbCr color space into the RGB color space.

In an embodiment, the compensating the pixel data may include multiplying a luminance compensation ratio to a luma component of the pixel data and compensating tone disappearance when a result of the multiplication of the luminance compensation ratio to the luma component of the pixel data is greater than a threshold value.

According to embodiments of the invention, the luminance of a backlight assembly may be adjusted according to image data. Advantageously, power consumption of a display apparatus may be minimized.

In one or more embodiments, the adjustment of the luminance of the backlight assembly may be performed and/or optimized in accordance with color perception of human eyes. Advantageously, color distortion a perceived by a viewer may be minimized.

BRIEF DESCRIPTION OF THE DRAWINGS

The above and other features and advantages of the present invention will become more apparent with reference to the detailed description and the accompanying drawings, wherein.

DETAILED DESCRIPTION OF THE INVENTION

Hereinafter, the present invention will be explained in detail with reference to the accompanying drawings.

Figure 1:
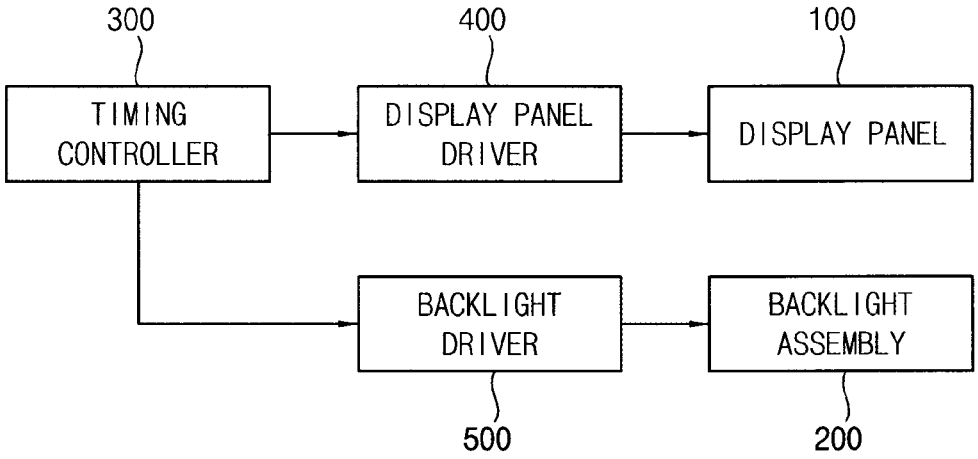
FIG. 1 is a block diagram illustrating a display apparatus according to an embodiment of the present invention.
Figure 2:
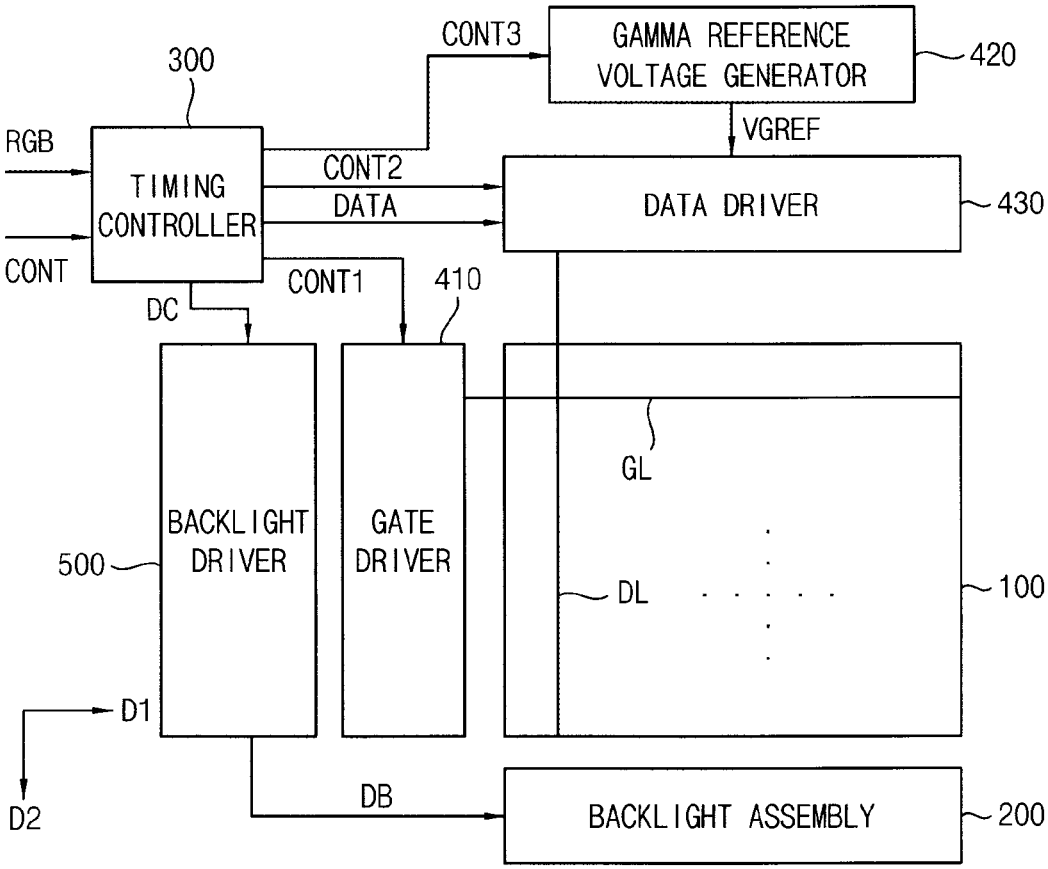
FIG. 2 is a block diagram further illustrating the display apparatus illustrated in FIG. 1.

FIG. 1 is a block diagram illustrating a display apparatus according to an embodiment of the present invention. FIG. 2 is a block diagram further illustrating the display apparatus illustrated in FIG. 1;

Referring to FIGS. 1 and 2, the display apparatus includes a display panel 100, a backlight assembly 200, a timing controller 300, a display panel driver 400, and a backlight driver 500. The display panel driver 400 includes a gate driver 410, a gamma reference voltage generator 420, and a data driver 430.

The display panel 100 may display an image. The display panel 100 has a display region on which an image may be displayed and a peripheral region adjacent to the display region.

The display panel 100 includes a plurality of gate lines GL, a plurality of data lines DL, and a plurality of unit pixels connected to the gate lines GL and the data lines DL. The gate lines GL extend in a first direction D1, and the data lines DL extend in a second direction D2 crossing the first direction D1.

Each unit pixel includes a switching element (not shown), a liquid crystal capacitor (not shown), and a storage capacitor (not shown). The liquid crystal capacitor and the storage capacitor are electrically connected to the switching element. The unit pixels may be disposed in a matrix form.

The backlight assembly 200 may provide light to the display panel 100. For example, the backlight assembly 200 may include a plurality of light emitting diodes.

The backlight assembly 200 may be a direct type backlight assembly that is disposed under the display panel 100 to provide light to the display panel 100. The backlight assembly 200 may be an edge type backlight assembly that is disposed corresponding to a side portion of the display panel 100 to provide light to the display panel 100.

The backlight assembly 200 may be a global dimming type backlight assembly, in which a plurality of light sources is commonly controlled. Alternatively, the backlight assembly 200 may be a local dimming type backlight assembly, which includes a plurality of light source blocks that may be independently driven.

The timing controller 300 may receive input image data RGB and an input control signal CONT from an external apparatus (not shown). The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 300 may generate a first control signal CONT1, a second control signal CONT2, a third control signal CONT3, a backlight control signal DC, and a data signal DATA based on the input image data RGB and the input control signal CONT.

The timing controller 300 may generate the first control signal CONT1 for controlling operation of the gate driver 410 based on the input control signal CONT. The timing controller 300 may output the first control signal CONT1 to the gate driver 410. The first control signal CONT1 may include a vertical start signal and a gate clock signal.

The timing controller 300 may generate the second control signal CONT2 for controlling operation of the data driver 430 based on the input control signal CONT. The timing controller may output the second control signal CONT2 to the data driver 430. The second control signal CONT2 may include a horizontal start signal and a load signal.

The timing controller 300 may generate the data signal DATA based on the input image data RGB. The timing controller 300 may output the data signal DATA to the data driver 430.

The timing controller 300 may generate the third control signal CONT3 for controlling operation of the gamma reference voltage generator 420 based on the input control signal CONT. The timing controller may output the third control signal CONT3 to the gamma reference voltage generator 420.

The timing controller 300 may generate the backlight control signal DC for controlling operation of the backlight driver 500 based on the input image data RGB. The timing controller 300 may output the backlight control signal DC to the backlight driver 500. The backlight control signal DC may include a duty ratio signal (%) configured to adjust luminance of at least a light source of the backlight assembly 200.

A structure of the timing controller 300 is further explained with reference to FIG. 3.

The gate driver 410 may generate gate signals for driving the gate lines GL in response to the first control signal CONT1 received from the timing controller 300. The gate driver 410 may sequentially output the gate signals to the gate lines GL.

The gate driver 410 may be directly mounted on the display panel 100, may be connected to the display panel 100 as a tape carrier package ("TCP"), and/or may be integrated on the peripheral region of the display panel 100.

The gamma reference voltage generator 420 may generate a gamma reference voltage VGREF in response to the third control signal CONT3 received from the timing controller 300. The gamma reference voltage generator 420 may provide the gamma reference voltage VGREF to the data driver 430. The gamma reference voltage VGREF may have a value that corresponds to a level of the data signal DATA.

In an embodiment, the gamma reference voltage generator 420 may be disposed in the timing controller 300 or in the data driver 430.

The data driver 430 may receive the second control signal CONT2 and the data signal DATA from the timing controller 300; the data driver 430 may receive the gamma reference voltages VGREF from the gamma reference voltage generator 420. The data driver 430 may convert the data signal DATA into analog data voltages using the gamma reference voltages VGREF. The data driver 430 may output the data voltages to the data lines DL.

The data driver 430 may be directly mounted on the display panel 100, may be connected to the display panel 100 in a TCP, and/or may be integrated on the peripheral region of the display panel 100.

The backlight driver 500 may receive the backlight control signal DC from the timing controller 300. For example, the backlight control signal DC may be related to the duty ratio (%) of at least a light source of the backlight assembly 200.

The backlight driver 500 may generate a backlight driving signal DB based on the backlight control signal DC. For example, the backlight control signal DC may be a pulse width modulation signal.

The backlight driver 500 may output the backlight driving signal DB to the backlight assembly 200 to control the backlight assembly 200.

Figure 3:
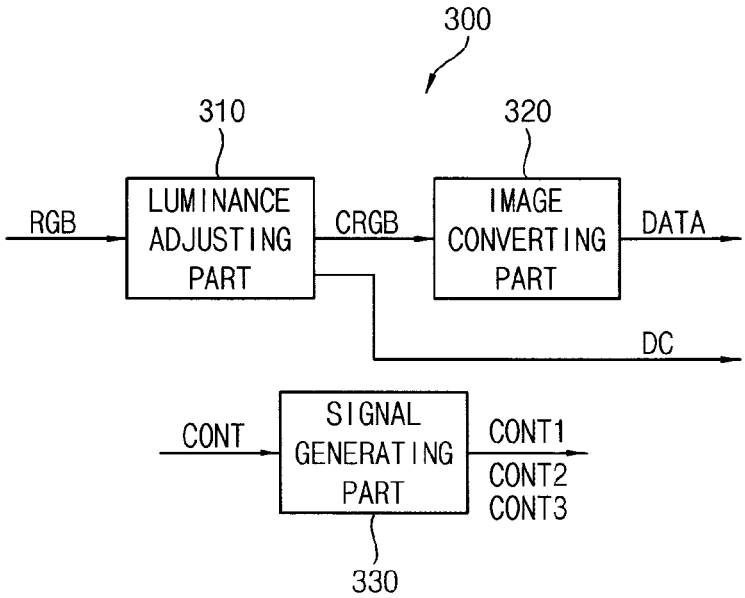
FIG. 3 is a block diagram illustrating a timing controller illustrated in FIG. 1.

FIG. 3 is a block diagram illustrating the timing controller 300 illustrated in FIG. 1.

Referring to FIGS. 1 to 3, the timing controller 300 includes a luminance adjustment part 310 (or luminance adjusting part 310), an image conversion part 320 (or image converting part 320), and a signal generation part 330 (or signal generating part 330). The timing controller 300 may include or may be logically divided into the above-mentioned elements without physically including or being physically divided into the above-mentioned elements.

The luminance adjustment part 310 may receive the input image data RGB. The luminance adjustment part 310 may determine luminance for the backlight assembly 200 based on the input image data RGB. In addition, the luminance adjustment part 310 may compensate pixel data to be used for the display panel 100 based on the luminance for the backlight assembly 200.

The luminance adjustment part 310 may output the backlight control signal DC related to the luminance of the backlight assembly 200 to the backlight driver 500. The luminance adjustment part 310 may output the luminance compensated pixel data CRGB to the image conversion part 320.

A structure of the luminance adjustment part 310 is explained with reference to FIGS. 4 to 7.

The image conversion part 320 may receive the luminance compensated pixel data CRGB from the luminance adjustment part 310.

The image conversion part 320 may compensate grayscale data of the luminance compensated pixel data CRGB and may rearrange the luminance compensated pixel data CRGB to generate the data signal DATA of a data type suitable for the data driver 430. The data signal DATA may be a digital signal. The image conversion part 320 may output the data signal DATA to the data driver 430.

For example, the image conversion part 320 may include an adaptive color correction part (or adaptive color correcting part, not shown) and a dynamic capacitance compensation part (or dynamic capacitance compensating part, not shown).

The adaptive color correcting part may receive the grayscale data of the luminance compensated pixel data CRGB and may perform adaptive color correction ("ACC") to compensate the grayscale data using, for example, a gamma curve.

The dynamic capacitance compensating part may perform dynamic capacitance compensation ("DCC") to compensate the grayscale data of present frame data using previous frame data and the present frame data.

The signal generation part 330 may receive the input control signal CONT. Based on the input control signal CONT, the signal generation part 330 may generate the first control signal CONT1 for controlling a driving timing of the gate driver 410, signal generation part may generate the second control signal CONT2 for controlling a driving timing of the data driver 430, and may generate the third control signal CONT3 for controlling a driving timing of the gamma reference voltage generator 420.

The signal generation part 330 may output the first control signal CONT1 to the gate driver 410. The signal generation part 330 may output the second control signal CONT2 to the data driver 430. The signal generation part 330 may output the third control signal CONT3 to the gamma reference voltage generator 420.

Figure 4:
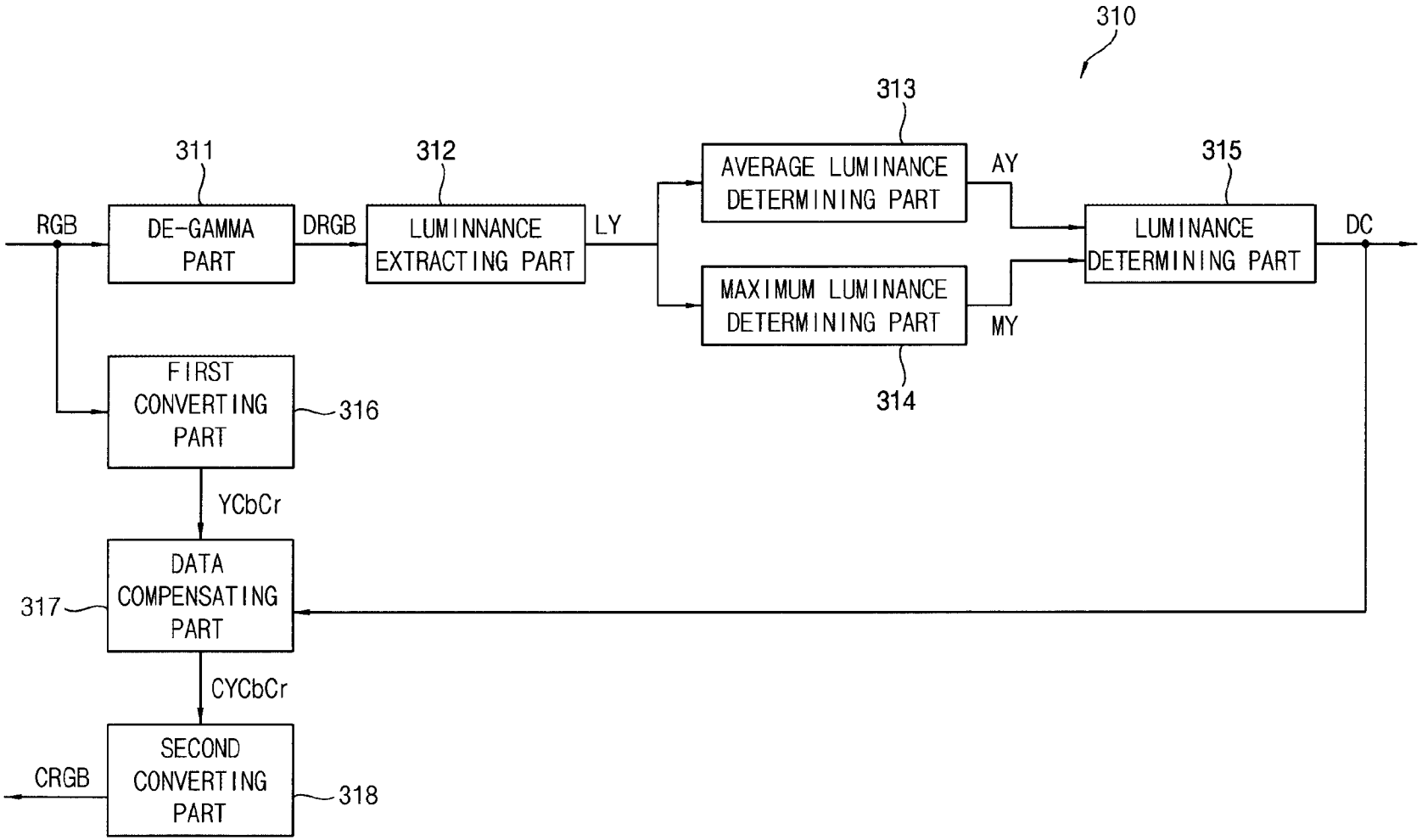
FIG. 4 is a block diagram illustrating a luminance adjustment part illustrated in FIG. 3.
Figure 5A:
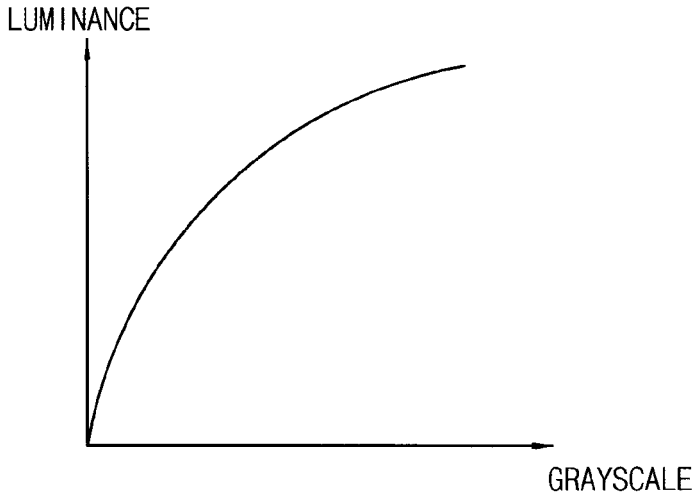
FIG. 5A is a graph illustrating a luminance curve of input image data.
Figure 5B:
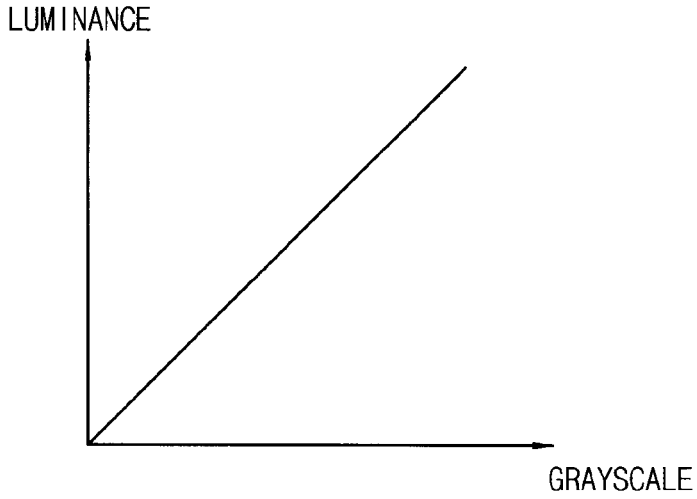
FIG. 5B is a graph illustrating a luminance curve of de-gamma image data outputted from a de-gamma part.
Figure 6:
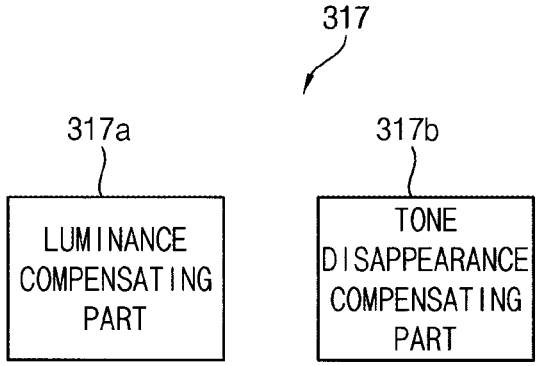
FIG. 6 is a block diagram illustrating a data compensation part illustrated in FIG. 4.
Figure 7:
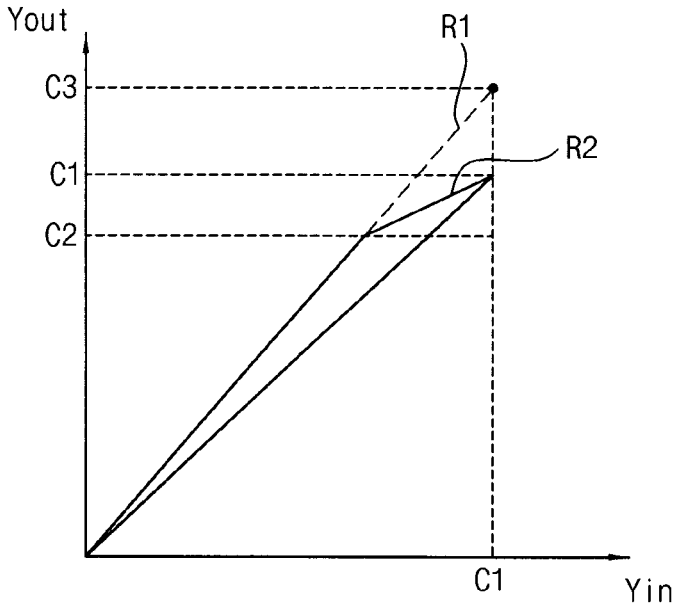
FIG. 7 is a graph illustrating an operation of a color disappearance compensation part illustrated in FIG. 6.

FIG. 4 is a block diagram illustrating the luminance adjustment part 310 illustrated in FIG. 3. FIG. 5A is a graph illustrating a luminance curve of input image data RGB. FIG. 5B is a graph illustrating a luminance curve of de-gamma image data DRGB (or substantially linearized image data DRGB) outputted from a de-gamma part 311 of the luminance adjustment part 310. FIG. 6 is a block diagram illustrating a data compensation part 317 (or data compensating part 317) of the luminance adjustment part 310 illustrated in FIG. 4. FIG. 7 is a graph illustrating an operation of a tone disappearance compensation part 317*b* (i.e., tone disappearance compensating part 317*b* or color disappearance compensating part 317*b*) of the data compensation part 317 illustrated in FIG. 6.

Referring to FIGS. 1 to 7, the luminance adjustment part 310 includes a de-gamma part 311, a luminance extraction part 312 (or luminance extracting part 312), an average luminance determination part 313 (or average luminance determining part 313), a maximum luminance determination part 314 (or maximum luminance determining part 314), a luminance determination part 315 (or luminance determining part 315), a first conversion part 316 (or first converting part 316), a data compensation part 317 (or data compensating part 317), and a second conversion part 318 (or second converting part 318).

The de-gamma part 311 may receive the input image data RGB. The input image data RGB may have data related to (and/or specified in accordance with) an RGB color space. The de-gamma part 311 may perform a de-gamma process on the input image data RGB to generate a de-gamma image data DRGB (i.e., substantially linearized image data DRGB). The de-gamma image data DRGB may have data related to (and/or specified in accordance with) the RGB color space. The de-gamma image data DRGB may include de-gamma red data, de-gamma green data, and de-gamma blue data.

When the input image data RGB are generated at an imaging device (such as a camera), a gamma value is generally applied to the input image data RGB so that the input image data RGB has a non-linear luminance profile, such as the luminance profile illustrated in FIG. 5A. The input image data RGB has luminance values represented by a nonlinear function of grayscale values. For example, the gamma value associated with FIG. 5A may be about 1/(2.2).

The de-gamma part 311 performs the de-gamma process on the input image data RGB so that the de-gamma image data DRGB may have a substantially linear luminance profile, such as the linear luminance profile illustrated in FIG. 5B. The de-gamma image data DRGB have luminance values represented by a linear function of grayscale values.

The luminance extraction part 312 may receive the de-gamma image data DRGB. The luminance extraction part 312 may extract luminance values LY based on the linear de-gamma image data DRGB, wherein the extracted luminance value LY may be called linear Y for conciseness. The luminance values LY have a substantially linear profile according to the grayscale values.

In an embodiment, the luminance extraction part 312 may convert values of the de-gamma image data DRGB specified in accordance with the RGB color space into values specified in accordance with the YCbCr color space to extract the luminance value LY (or linear Y).

In an embodiment, an extracted luminance value LY may be determined as a sum of about 20% of the de-gamma red data, about 70% of the de-gamma green data, and about 10% of the de-gamma blue data. Extracted luminance values LY may be determined as sums of about 20% of the de-gamma red data, about 70% of the de-gamma green data, and about 10% of the de-gamma blue data The average luminance determination part 313 may determine an average luminance value AY corresponding to a frame based on the extracted luminance values LY. The average luminance determination part 313 may output the average luminance value AY to the luminance determination part 315.

The maximum luminance determination part 314 may determine a maximum luminance value MY corresponding to a frame based on the extracted luminance values LY. The maximum luminance determination part 314 may output the maximum luminance value MY to the luminance determination part 315.

The luminance determination part 315 may receive the average luminance value AY from the average luminance determination part 313. The luminance determination part 315 may receive the maximum luminance value MY from the maximum luminance determination part 314.

The luminance determination part 315 may determine a luminance value of a backlight control signal DC for controlling the backlight assembly 200 based on the average luminance value AY and the maximum luminance value MY corresponding to a frame.

In an embodiment, the luminance determination part 315 may determine the luminance value for controlling the backlight assembly 200 to be between the average luminance value AY and the maximum luminance value MY.

In an embodiment, the luminance determination part 315 may determine the luminance value for a present frame (a second frame) based on the average luminance value AY and the maximum luminance value MY of a previous frame (a first frame).

In an embodiment, the luminance determination part 315 may determine the luminance value for a present frame based on the average luminance value AY and the maximum luminance value MY of the present frame. In an embodiment, the timing controller 300 further includes a frame memory for storing image data of the present frame.

The luminance determination part 315 may include a low pass filter. The low pass filter may adjust the luminance value for controlling the backlight assembly 200 such that the luminance of the backlight assembly 200 does not drastically change during two consecutive frames.

In an embodiment, the luminance value in the backlight control signal DC for controlling the backlight assembly 200 may be represented by a duty ratio.

The luminance determination part 315 may output the backlight control signal DC (including and/or representing the luminance value for controlling the backlight assembly 200) to the backlight driver 500 and to the data compensation part 317.

The first conversion part 316 may receive the input image data RGB (which may have a nonlinear luminance profile). The first conversion part 316 may convert the input image data RGB into first converted data YCbCr.

For example, the input image data RGB has values specified in accordance with the RGB color space. The first conversion part 316 may be a RGB to YCbCr converter converting values in accordance with the RGB color space into values in accordance with the YCbCr color space. Thus, the first converted data YCbCr may have values specified in accordance with the YCbCr color space.

The data compensation part 317 may receive the first converted data YCbCr (having values in accordance with the YCbCr color space) from the first conversion part 316. The data compensation part 317 may receive the backlight control signal DC (configured for controlling the luminance of the backlight assembly 200) from the luminance determination part 315.

The first converted data YCbCr may correspond to image data to be displayed by at least a pixel of the display panel 100, and the first converted data YCbCr may include one or more targets of the compensation to be performed by the data compensation part 317. The first converted data YCbCr may be called pixel data YCbCr.

The data compensation part 317 may multiply a luminance compensation ratio (or luminance compensating ratio) to a luma component Y of the pixel data YCbCr to compensate the pixel data YCbCr. The data compensation part 317 may not compensate one or both of chroma components Cb and Cr of the pixel data YCbCr.

The data compensation part 317 may compensate the pixel data YCbCr to generate compensated data CYCbCr. The compensated data CYCbCr may have values specified in accordance with the YCbCr color space.

The first converted data YCbCr (or pixel data YCbCr) may be generated based on a copy of the input image data RGB that is not processed by the de-gamma part 311; thus, the luma component Y of the first converted data YCbCr may have a non-linear luminance profile and may be called a nonlinear Y for conciseness. The luminance values LY has a substantially linear profile according to the grayscale values.

In an embodiment, the data compensation part 317 may compensate the nonlinear pixel data YCbCr (in particular the nonlinear Y) using the luminance value(s) specified in the backlight control signal DC, which is generated using the previously discussed luminance value LY (linear Y) extracted from the linear de-gamma image data DRGB.

In an embodiment, if the luminance compensation ratio is represented by LCR and if the duty ratio for controlling the backlight assembly 200 is represented by DC, the luminance compensation ratio LCR may be determined using the following Equation 1.

$$LCR = \left(1 - \frac{DC}{100}\right)^{1.4} \quad \text{[Equation 1]}$$

In an embodiment, the data compensation part 317 may compensate the pixel data YCbCr using a lookup table representing calculations involving the luminance compensation ratio LCR. Thus, the luminance adjustment part 310 may be easily designed in hardware, and the luminance compensation ratio LCR may be flexibly adjusted.

In an embodiment, if the luminance compensation ratio is represented by LCR, if the duty ratio for controlling the backlight assembly 200 is represented by DC, and if the duty ratio DC is between about 25% and about 50%, the luminance compensation ratio LCR may be determined using the following Equation 2. If the duty ratio DC for controlling the backlight assembly 200 is greater than about 50%, the luminance compensation ratio LCR may be determined using the following Equation 3.

$$LCR = \left(\frac{1 - \frac{DC}{100}}{0.8}\right)^{2.2} \quad \text{[Equation 2]}$$

$$LCR = \left(1 - \frac{DC}{100}\right)^{1.4} \quad \text{[Equation 3]}$$

In an embodiment, as illustrated in FIG. 6, the data compensation part 317 may include a luminance compensation part 317*a* (or luminance compensating part 317*a*) and a tone disappearance compensation part 317*b* (or tone disappearance compensating part 317*b*). The luminance compensation part 317*a* may multiply the luma component Y of the pixel data YCbCr by the luminance compensation ratio LCR. The tone disappearance compensation part 317*b* may compensate the tone disappearance if a result of the multiplication of the luma component Y of the pixel data YCbCr by the luminance compensation ratio LCR is greater than a threshold value.

When the luma component Y of the pixel data YCbCr is multiplied by the luminance compensation ratio LCR to generate the compensation data YCbCr, all of the luma components Y of the pixel data YCbCr equal to or greater than a specific value are converted to a maximum luminance value. Thus, the luma components Y of the pixel data YCbCr equal to or greater than the specific value are mapped to the same luminance; as a result, tone disappearance may occur.

The tone disappearance compensation part 317*b* may set a boundary value of a color range based on the color space associated with the pixel data YCbCr and the duty ratio DC configured for controlling the backlight assembly 200.

A primitive boundary value C of the color range corresponding to a duty ratio DC of 100% is calculated. If the pixel data YCbCr is located in a Yellow-White-Cyan plane, the primitive boundary value C of the color range may be determined using the following Equation 4. If the pixel data YCbCr is located in a Cyan-White-Magenta plane, the primitive boundary value C of the color range may be determined using the following Equation 5. If the pixel data YCbCr is located in a Magenta-White-Yellow plane, the primitive boundary value C of the color range is determined using the following Equation 6.

$$C=0.20*Cb+0.45*Cr+171.7 \quad \text{[Equation 4]}$$

$$C=-1.84*Cb+491 \quad \text{[Equation 5]}$$

$$C=-1.59*Cr+459 \quad \text{[Equation 6]}$$

If a maximum grayscale is 255, the boundary value C1 of the color range may be determined using the following Equation 7 based on the primitive boundary value C of the color range and the duty ratio DC for the backlight assembly 200.

$$C1=C-(1-DC/100)*255 \quad \text{[Equation 7]}$$

The boundary value C1 of the color range may be multiplied by a constant value to determine the threshold value C2 using the following Equation 8. For example, the constant value may be about 0.9.

$$C2=C1*0.9 \quad \text{[Equation 8]}$$

A result of a multiplication of the boundary value C1 of the color range by the luminance compensation ratio LCR may be represented as a value C3. The value C3 may represent a luminance point at which a line representing a multiplication of the luma component Y of the pixel data YCbCr by the luminance compensation ratio LCR meets the boundary value C1 of the color range.

If an input luminance value Yin is defined as a multiplication of the luma component Y of the pixel data YCbCr by the luminance compensation ratio LCR and if an output luminance value Yout is defined as an output of the tone disappearance compensation part 317*b*, the output luminance value Yout may be determined using the following Equation 9.

$$Yout = \left(\frac{C1 - C2}{C3 - C2}\right) \times (Yin - C2) + C2 \quad \text{[Equation 9]}$$

Input luminance values Yin in a luminance range R1 between the threshold value C2 and the value C3 may be compensated to generate output luminance values Yout in a luminance range R2 between the threshold value C2 and the boundary value C1 of the color range.

Thus, the tone disappearance compensation part 317*b* may prevent images having luminances greater than the threshold value from being mapped to the same luminance Advantageously, satisfactory display quality may be provided.

The second conversion part 318 may receive the compensated data CYCbCr having values specified in accordance with the YCbCr color space.

The second conversion part 318 may convert the compensated data CYCbCr having values specified in accordance with the YCbCr color space into data having values specified in accordance with the RGB color space. The second conversion part 318 may output the luminance compensated pixel data CRGB (having values specified in accordance with the RGB color space) to the image conversion part 320.

According to embodiments of the present invention, luminance of a backlight assembly may be adjusted using a luminance value extracted from linear image data, and pixel data may be adjusted using non-linear image data. As a result, images with desirable color coordinates may be satisfactorily displayed in spite of adjustment of the luminance of the backlight assembly. Advantageously, color distortion of displayed images as perceived by a viewer may be minimized when power consumption of a display apparatus is decreased.

The foregoing is illustrative of embodiments of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A luminance adjustment part comprising:

a luminance determination part configured to determine a control value for controlling luminance of a backlight assembly using linear image data, the linear image data being generated by performing a de-gamma process on a first copy of input image data, the linear image data having a linear luminance profile, the input image data having a nonlinear luminance profile; and a data compensation part configured to compensate pixel data that corresponds to pixels of a display panel using the control value, the pixel data being generated using a second copy of the input image data, wherein the data compensation part comprises:

a luminance compensation part for multiplying a luma component of the pixel data by a luminance compensation ratio to generate a multiplication result; and a tone disappearance compensation part for compensating tone disappearance if the multiplication result is greater than a threshold value.

2. The luminance adjustment part of claim 1, wherein the input image data is specified in accordance with an RGB color space, and wherein the pixel data is specified in accordance with a YCbCr color space.

3. The luminance adjustment part of claim 1, wherein the luminance determination part is configured to determine the control value associated with a second frame using at least one of an average luminance value of extracted luminance values corresponding to a first frame and a maximum luminance value of the extracted luminance values corresponding to the first frame, the extracted luminance values being extracted from the linear image data.

4. The luminance adjustment part of claim 3, wherein the luminance determination part comprises a low pass filter for adjusting the control value such that a change of the control value does not exceed a threshold during two consecutive frames.

5. The luminance adjustment part of claim 1, further comprising:

a de-gamma part for receiving the input image data and for generating the linear image data using the input image data;

a luminance extraction part for extracting extracted luminance values from the linear image data;

an average luminance determination part for determining an average luminance value associated with a frame using the extracted luminance values; and a maximum luminance determination part for determining a maximum luminance value associated with the frame using the extracted luminance values.

6. The luminance adjustment part of claim 5, wherein the linear image data have data values specified in accordance with a RGB color space and including red data, green data, and blue data that have respective linear luminance profiles, and wherein at least one of the extracted luminance values is determined as a sum of about 20% of the red data, about 70% of the green data, and about 10% of the blue data.

7. The luminance adjustment part of claim 1, further comprising:

a first conversion part for receiving the second copy of the input image data and for converting the second copy of the input image data into the pixel data, the input image data being specified according to an RGB color space, the pixel data being specified according to a YCbCr color space; and a second conversion part for receiving compensated data that is specified according to the YCbCr color space from the data compensation part and for converting the compensated data into compensated pixel data that is specified according to the RGB color space.

8. The luminance adjustment part of claim 1, wherein if the luminance compensation ratio is represented by LCR and if a duty ratio for controlling the backlight assembly is represented by DC, then $$LCR = \left(1 - \frac{DC}{100}\right)^{1.4}.$$

9. The luminance adjustment part of claim 1, wherein if the luminance compensation ratio is represented by LCR, if a duty ratio for controlling the backlight assembly is represented by DC, if the duty ratio is between about 25% and about 50%, then $$LCR = \left(\frac{1 - \frac{DC}{100}}{0.8}\right)^{2.2},$$

and if the duty ratio is greater than about 50%, then $$LCR = \left(1 - \frac{DC}{100}\right)^{1.4}.$$

10. The luminance adjustment part of claim 1, wherein a boundary value of a color range is set based on a color space associated with the pixel data and a duty ratio received from the luminance determination part, the control value including the duty ratio, wherein the boundary value of the color range is multiplied by a constant value to determine the threshold value, and wherein if an input luminance value Yin represents the multiplication result, if an output luminance value Yout represents an output of the tone disappearance compensation part, if the boundary value of the color range is represented by C1, if the threshold value is represented by C2, and if a result of multiplying C1 by a luminance compensation ratio LCR is represented by C3, then $$Yout = \left(\frac{C1 - C2}{C3 - C2}\right) \times (Yin - C2) + C2.$$

11. A display apparatus comprising:

a display panel for displaying an image;

a backlight assembly for providing light to the display panel;

a gate driver for providing a gate signal to the display panel;

a data driver for providing a data voltage to the display panel;

a backlight driver for providing a backlight driving signal to the backlight assembly; and a timing controller comprising a luminance determination part configured to determine a control value for controlling luminance of the backlight assembly using linear image data, the linear image data being generated by performing a de-gamma process on a first copy of input image data, the linear image data having a linear luminance profile, the input image data having a nonlinear luminance profile, the timing controller further comprising a data compensation part configured to compensate pixel data that corresponds to pixels of the display panel using the control value, the pixel data being generated using a second copy of the input image data, the timing controller being configured for controlling the gate driver, the data driver, and the backlight driver, wherein the data compensation part comprises:

a luminance compensation part for multiplying a luma component of the pixel data by a luminance compensation ratio to generate a multiplication result; and a tone disappearance compensation part for compensating tone disappearance if the multiplication result is greater than a threshold value.

12. A method for adjusting luminance using a luminance adjustment part that includes hardware, the method comprising:

generating linear image data by performing a de-gamma process on a first copy of input image data, the linear image data having a linear luminance profile, the input image data having a nonlinear luminance profile;

determining a control value for controlling luminance of a backlight assembly using the linear image data;

generating pixel data that corresponds to pixels of a display panel using a second copy of the input image data; and compensating the pixel data using the control value, wherein the compensating the pixel data comprises:

multiplying a luma component of the pixel data by a luminance compensation ratio to generate a multiplication result; and compensating tone disappearance when the multiplication result is greater than a threshold value.

13. The method of claim 12, wherein the input image data is specified in accordance with an RGB color space, and wherein the pixel data is specified in accordance with a YCbCr color space.

14. The method of claim 12, wherein the control value associated with a second frame is determined using at least one of an average luminance value of extracted linear luminance values corresponding to a first frame and a maximum luminance value of the extracted luminance values corresponding to the first frame, the extracted luminance values being extracted from the linear image data.

15. The method of claim 14, further comprising low pass filtering the control value such that a change of the control value does not exceed a threshold during two consecutive frames.

16. The method of claim 12, further comprising:

extracting extracted luminance values from the linear image data;

determining an average luminance value associated with a frame using the extracted luminance values; and determining a maximum luminance value associated with the frame using the extracted luminance values.

17. The method of claim 16, wherein the linear image data have data values specified in accordance with a RGB color space and including red data, green data, and blue data that have respective linear luminance profiles, and wherein at least one of the extracted luminance values is a sum of about 20% of the red data, about 70% of the green data and about 10% of the blue data.

18. The method of claim 12, comprising:

converting the second copy of the input image data into the pixel data, the input image data being specified according to an RGB color space, the pixel data being specified according to a YCbCr color space;

compensating the pixel data to generate compensated data that is specified in accordance with the YCbCr color space; and converting the compensated data into compensated pixel data that is specified according to the RGB color space.

* * * * *